US005345630A

United States Patent [19]

Healy

[11] Patent Number: 5,345,630

[45] Date of Patent: Sep. 13, 1994

[54] QUICK INFLATABLE AIR MATTRESS

[76] Inventor: Jack Healy, 11333 Moorpark St., #128, Toluca Lake, Calif. 91602

[21] Appl. No.: 92,006

[22] Filed: Jul. 15, 1993

[51] Int. Cl.[5] ..... A47C 27/08

[52] U.S. Cl. ..... 5/454; 5/615; 5/634; 137/270; 137/512.4

[58] Field of Search ..... 5/615, 633, 634, 449, 5/454; 137/270, 512.4

[56] References Cited

U.S. PATENT DOCUMENTS

| | | | |
|---|---|---|---|
| 388,037 | 8/1888 | Hargin | 5/454 |
| 2,369,736 | 2/1945 | Hurt | 5/454 |
| 2,372,218 | 3/1945 | Manson et al. | 5/454 |
| 2,686,006 | 8/1954 | Hasselquist | 5/454 X |
| 3,042,941 | 7/1962 | Marcus | 5/454 |
| 3,068,494 | 12/1962 | Pinkwater | 5/348 |
| 3,606,623 | 9/1971 | Aymar | 5/634 X |
| 3,781,928 | 1/1974 | Swallert | 5/615 X |
| 4,521,166 | 6/1985 | Phillips | 5/454 X |
| 4,621,383 | 11/1986 | Gendala | 5/454 |
| 4,862,533 | 9/1989 | Adams, III | 5/454 X |
| 4,873,731 | 10/1989 | Williamson | 5/615 |

*Primary Examiner*—Michael F. Trettel
*Attorney, Agent, or Firm*—Poms, Smith, Lande & Rose

[57] ABSTRACT

A self-inflatable air mattress having a built-in bellows. A portion of the air mattress support is manually moved up and down actuating the bellows to introduce air into the mattress. The air inlet is of large area and a substantial amount of air is introduced upon each manual actuation of the support. A valve may be associated with the bellows and air inlet to selectively reverse the air flow so that the air mattress can be quickly deflated, if desired.

11 Claims, 3 Drawing Sheets

FIG. 1
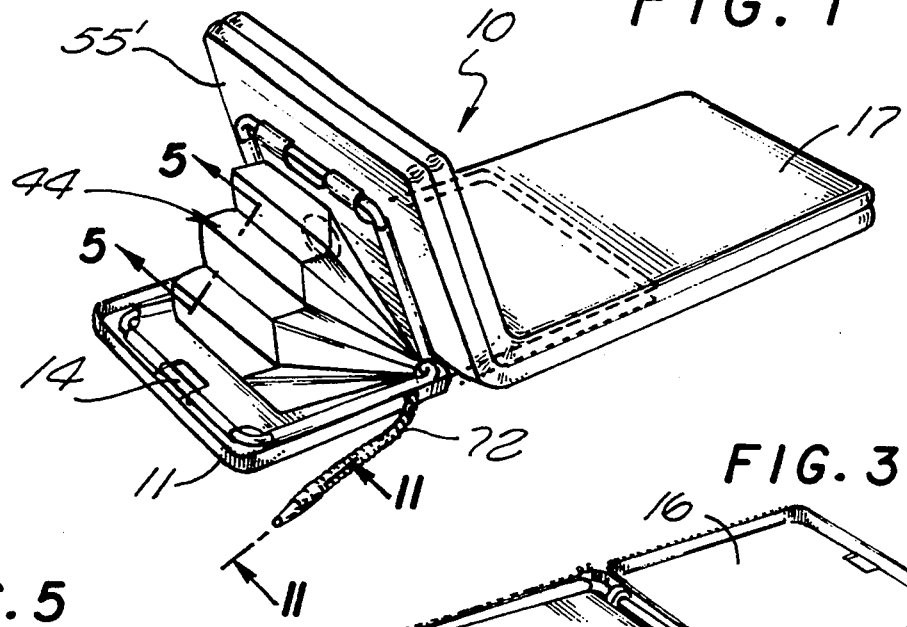
FIG. 3
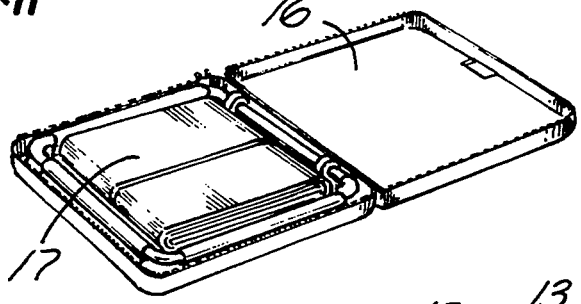
FIG. 5
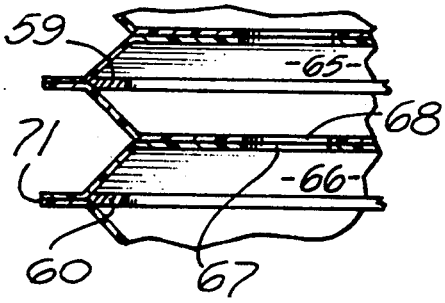
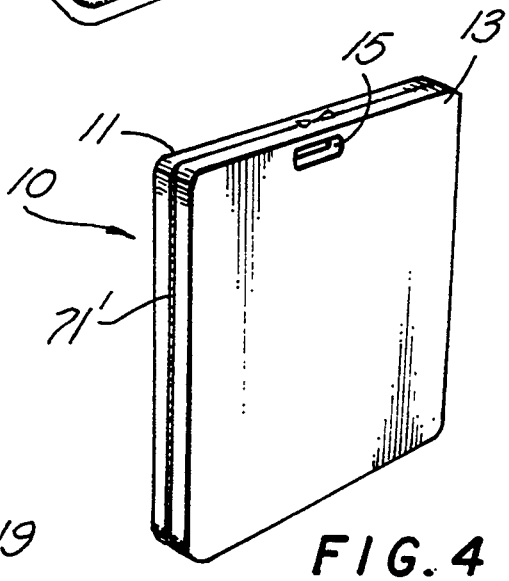
FIG. 4
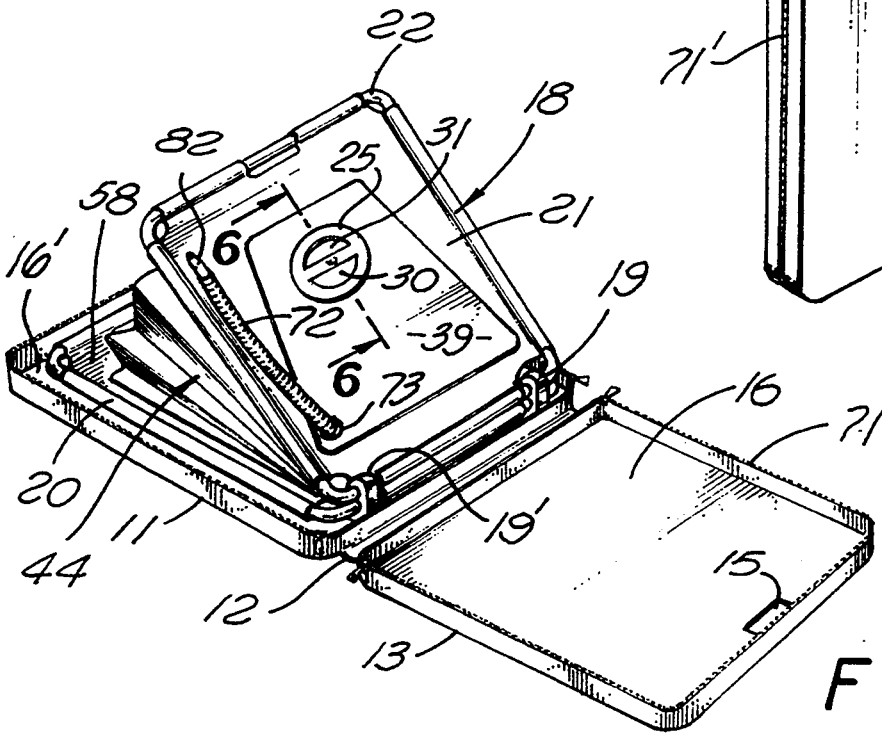
FIG. 2

QUICK INFLATABLE AIR MATTRESS

BACKGROUND OF THE INVENTION

1. Field of the Invention

The invention relates to inflatable devices; and, more particularly, to a quick inflatable air mattress or the like.

2. Description of the Prior Art

Air mattresses and other inflatable devices are well known in the art. Generally, such devices have one or more air inlets which may be coupled to a pump or the like. One can thus activate the pump to introduce air into the inflatable device.

This is quite laborious and time consuming, particularly if one also had to deflate the device.

There is thus a need for a self inflated air mattress or other inflatable device which can be quickly and easily inflated or deflated.

SUMMARY OF THE INVENTION

It is an object of this invention to provide a quick inflatable air mattress.

It is a further object of this invention to provide an inflatable air mattress that can be quickly inflated or deflated.

These and other objects are preferably accomplished by providing a self-inflatable air mattress having a built-in bellows. A portion of the air mattress support is manually moved up and down actuating the bellows to introduce air into the mattress. The air inlet is very large in area and a substantial amount of air is introduced upon each manual actuation of the support with very little effort or back pressure. A valve may be associated with the bellows and air inlet to selectively reverse the air flow so that the air mattress can be quickly deflated, if desired.

BRIEF DESCRIPTION OF THE DRAWING

FIG. 1 is a perspective view of an air mattress assembly in accordance with the teachings of the invention, the air mattress being fully inflated;

FIG. 2 is a another perspective view of the assembly of FIG. 1 in open position, the mat removed for convenience of illustration;

FIG. 3 is a third perspective view of the assembly of FIG. 2 in folded position, the lounge being also in folded position;

FIG. 4 is a perspective view of the assembly of FIGS. 1 to 3 in folded position;

FIG. 5 is a sectional view taken along lines 5—5 of FIG. 2;

DESCRIPTION OF THE PREFERRED EMBODIMENT

Figure 7:
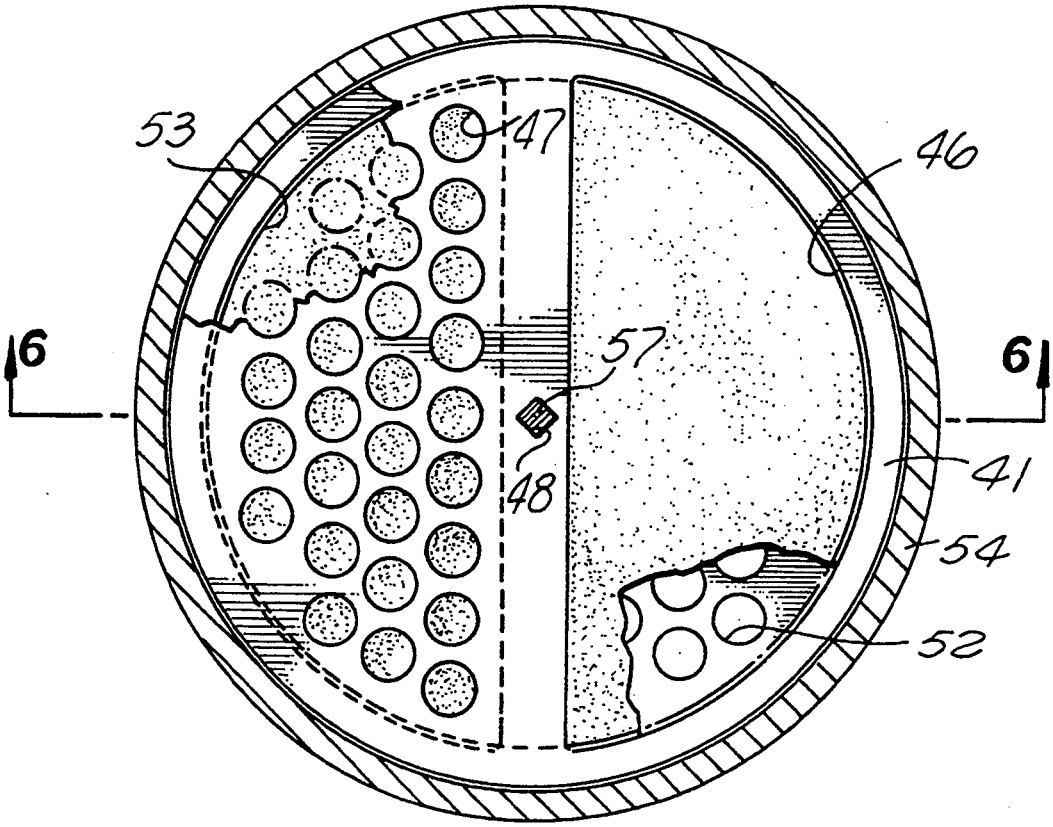
FIG. 7 is a sectional view along lines 7—7 of FIG. 6.

Referring now to FIG. 1 of the drawing, an air mattress device 10 is shown having first base portion 11 hinged at hinge 12 (FIG. 2) to a second generally planar base portion 13 to form a foldable carrying case as seen in FIG. 4. A pair of recessed handle portions 14, 15 (FIGS. 1 and 4) are provided in each side wall of each portion 11, 13 to provide a carrying handle.

As seen in FIG. 2, base portion 13 provides a compartment 16 for an inflatable air mattress 17 (shown in deflated view in FIG. 3 and inflated view in FIG. 1). A panel 18, (FIG. 2) is hinged to base portion 11 at pivots 19, 19'. Panel 18 is pivotally attached to a frame 20 disposed in base portion 11 by pivots 19, 19'. Panel 18 includes a flexible planar material 21 disposed around frame 22.

Figure 6:
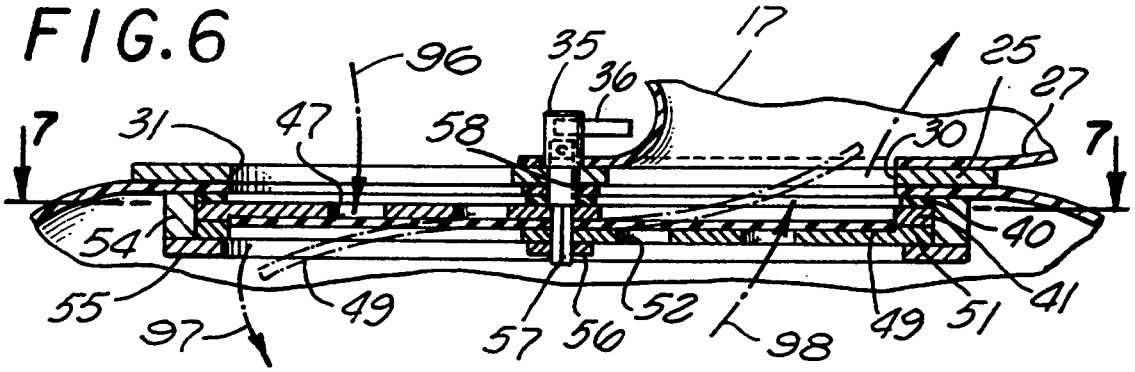
FIG. 6 is a sectional view taken along lines 6—6 of FIG. 7.

As seen in FIG. 6, the air mattress 17 is glued or otherwise secured to the upper half-circular aperture 30 (FIG. 2) of a flange plate 25 having an integral neck portion 27, (FIG. 6) communicating with aperture 30 in plate 25.

Plate 25 is shown in top plan view in FIG. 7. As seen, it is divided into two semi-circular openings, aforementioned aperture 30 and aperture 31.

Figure 8:
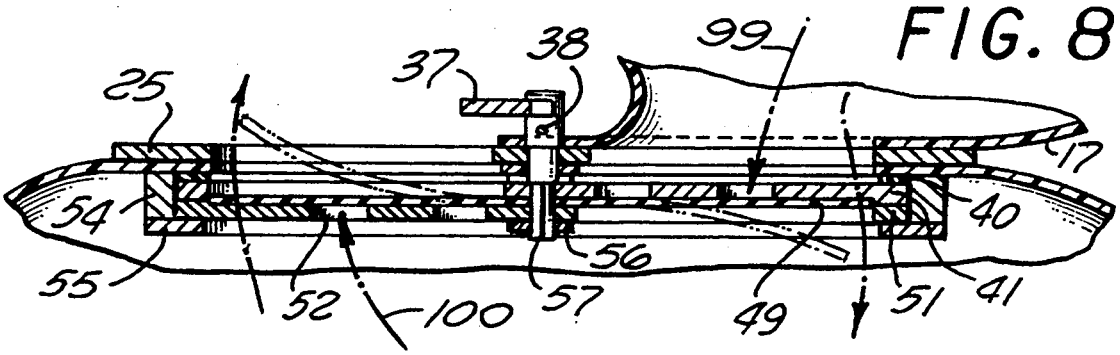
FIG. 8 is a view similar to FIG. 6 showing alternate positions thereof.

Plate 25 has a central rib 32 (FIG. 10) with a hole 33 therethrough separating apertures 30 and 31. As will be discussed, round hole 33 is adapted to receive cylindrical peg 34 extending from boss 35 having an elongated handle 36. Peg 34 is removably from boss 35 and retained therein by a retaining pin 37 entering through hole 38 in boss 35 and into a like hole (not visible—see also FIG. 8) thus removably attach boss 38 to pin 34.

Figure 9:
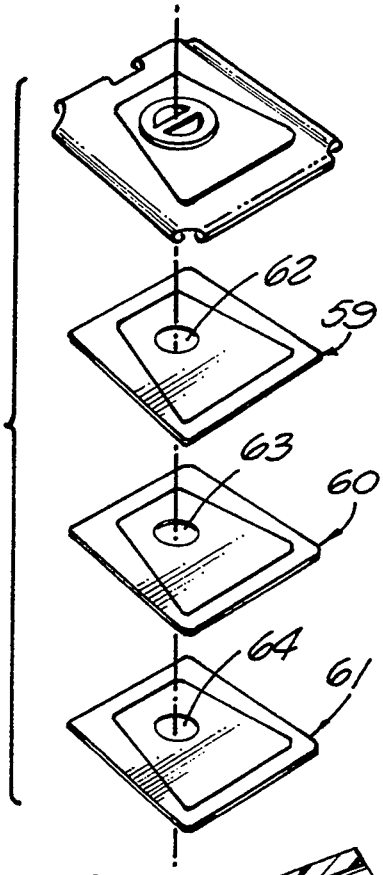
FIG. 9 is an exploded view of the assembly of FIG. 1.

Flange plate 25 (see FIGS. 2 and 9) is secured to panel 39 secured to planar material 21 of frame 22 (see also FIG. 2). A resilient seal 40 (FIG. 10) is provided between plate 41 and plate 25 (panel 39 being disposed between seal 40 and panel 39). Seal 40 is preferably of similar outer configuration, e.g., round, to plate 25, with semi-circular openings 42, 43 therethrough corresponding to apertures 30, 31 with a like central rib 44' having round opening 45 therethrough.

Plate 41 has a semi-circular opening 46 and a plurality of spaced holes 47 extending through plate 41. A central square shaped aperture 48 is provided in plate 41.

A round resilient thin disk 49, such as rubber, having a central square shaped aperture 50 aligned with aperture 48 is provided between plate 41 and a plate 51. Plate 51 is similar to plate 41 but has holes 52 on the side opposite from holes 47 in plate 41 and semi-circular opening 53 likewise on the opposite side from opening 46. Plate 51 also has a central hole 54' configured similarly to holes 48, 50.

A round spacer ring 54 is provided between ring 55 and plate 25. An elongated support bar 56 is disposed below ring 55 having a vertically extending central pin 57, which is preferably of the same configuration as holes 54', 48, and 50. Thus, pin 57 extends through holes 54', 50, and 48 whereas peg 34 extends down through holes 33, 45, the final assembled position being shown in FIGS. 6 and 7. As seen in FIGS. 6 and 7, disc 49 can be seen to be of lesser outer diameter than plates 51, 41 and spacer ring 54 is of greater outer diameter than plates 41, 51 so that it surrounds the same. Support ring 55 is of an outer diameter similar to spacer ring 54 but extends inwardly beyond ring 54 and under plate 51.

It can be appreciated that plate 25 and seal 40 remain stationary when handle 36 is rotated. However, since shaft pin 57 extends into a like configured hole 58 (FIG. 6) in peg 34, when handle 36 is turned, plates 41 and 51, and disc 49, rotate, as will be discussed further hereinbelow.

Bottom frame 20 (FIG. 2) also has an inner planar material section 58. Bellows 44 has a top apertured rigid panel 59 (FIG. 9—see also FIG. 5), a rigid apertured mid panel 60 and a lower apertured panel 61. Note in FIG. 9 that the holes 62 to 64 of panels 59–61, respectively, are aligned with openings 30, 31 in plate 25.

Bellows 44 is of an accordion-like resilient collapsible material divided into a plurality of sections, such as bellow sections 65, 66, etc., each section having an upper and lower portion secured to a bellows panel, such as upper and lower portions of bellow section 66 being secured to panel 60. Each section is secured to another section, such as section 65 to section 66, by gluing or the like. Each section has openings therein, such as opening 67 communicating with opening 68. The outer peripheral edges 71 of each section may be welded together.

As seen in FIGS. 2 and 4, a zipper 71' may be provided about the outer periphery of sections 11, 13.

As seen in FIG. 2, a hose 72 extends through opening 73 in panel 39 and into fluid communication with the interior of bellows 44 (see also FIG. 1). Hose 72 terminates in a threaded insert 74 (FIG. 11) having outer convolutions 75 securing insert 74 in a fluid tight manner to the convoluted interior 76 of hose 72.

Insert 74 is press fit onto end 78 of a valve body 79. Valve body 79 has an end 80 press fit into end 81 of a nipple 82 coupled to valve body 79 by an integral strap 82'.

Valve body 79 has a throughbore 83 communicating at one end with a chamber 84 and at the other end in a chamber 85. A valve 86 is provided having a valve shaft 87 reciprocal in throughbore 83. A first valve head 88 is provided at one end of shaft 87 protruding out of chamber 84 normally seating in valve seat 89 therein. A push button head 90 is provided at the other end of shaft 87 in chamber 85 adapted to abut valve wall 91 therein. A coiled spring 92 surrounds shaft 87 between button head 90 and wall 91.

Figure 11:
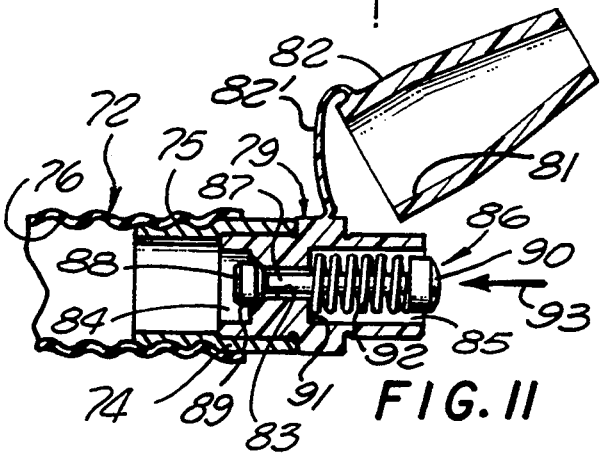
FIG. 11 is a sectional view taken along lines 11—11 of FIG. 1.
Figure 12:
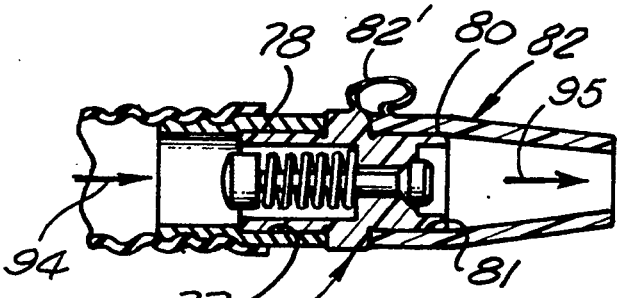
FIG. 12 is a view similar to FIG. 11 showing operation thereof.

It can be appreciated that air can be flowed through nozzle 82 in the direction of arrow 93 pushing against the bias of spring 92 (FIG. 11). In the position of valve 86 in FIG. 11, air cannot exit from bellows 44 out of nozzle 82. However, if valve body 79 is reversed as shown in FIG. 12, air from bellows 44 flowing in the direction of arrow 94 pushes valve 86 against the bias of spring 92 allowing air to exit out of nozzle 82 in the direction of arrow 95.

Figure 10:
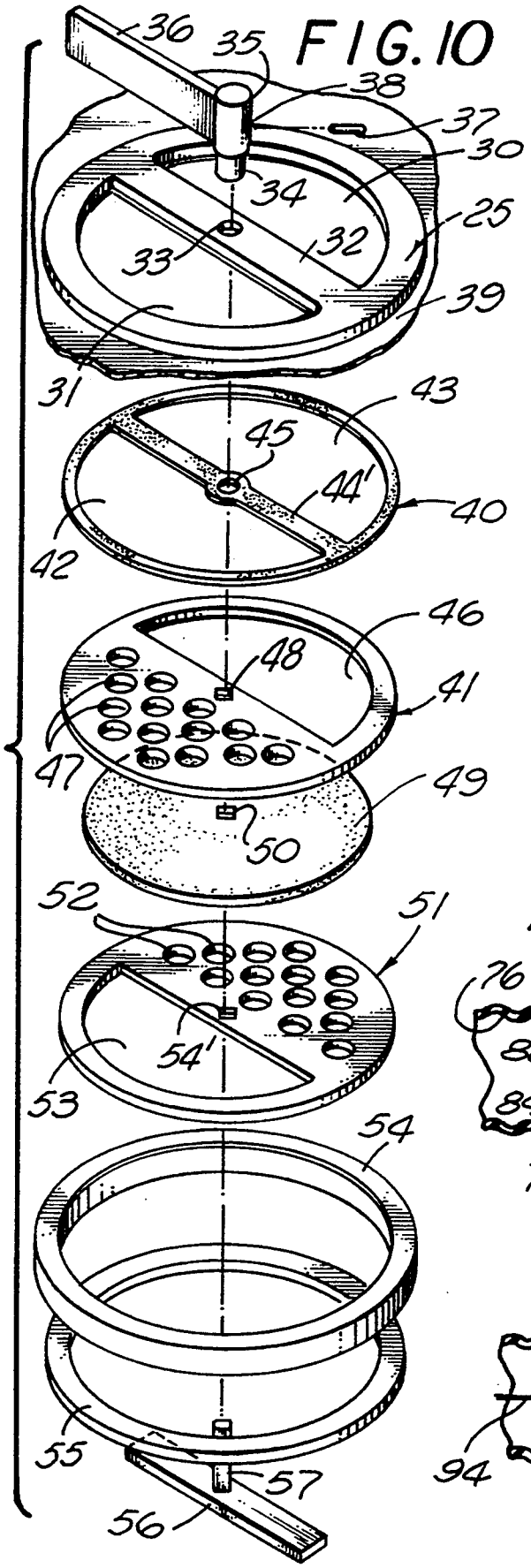
FIG. 10 is another exploded view of a portion of the assembly of FIG. 1.

The assembly of the parts of FIGS. 10 has been heretofore discussed. Bellows assembly 44 is attached to frame 20 and to support ring 55. Handle 36 is mounted to peg 34 and disposed on the opposite side of plate 25, and when rotated, rotates 41, 51 to present selectively either holes 52 or 47.

It can be appreciated that, by referring to FIGS. 6 and 7, opening 30 is aligned with holes 52 in plate 51, actuating the bellows 44 drawing air from the atmosphere (see arrow 96) via openings 47 into bellows 44 (see the arrow 97) past resilient disc 49 which moves to its dotted line position, and out of bellows 44, through openings 52 and into the interior of air mattress 17 as indicated by arrow 98 inflating the same. The foregoing is accomplished by selectively raising and lowering frame 18 with respect to frame 20. This quickly introduces air into air mattress 17 inflating the same. When fully inflated, frame 18 can be left in the FIG. 1 position.

Handle 36 is in the position shown in FIG. 6 during the foregoing process. When handle 36 is rotated to the FIG. 8 position, plates 41 and 51 and rotated to the opposite position from FIG. 10 and the process is reversed. Now, when frame 18 is raised and lowered as heretofore discussed, air is withdrawn out of the interior of air mattress 17, as indicated by arrow 99, through holes 47 flexing disc 49, into bellows 44, out of openings 52 (see arrow 100) to the atmosphere.

It can be seen that I have disclosed an inflatable air mattress assembly which has a bottom support, provides an adjustable back rest and can be quickly and easily inflated or deflated.

Other inflatable devices may be simultaneously inflated or deflated via hose 72, and valve 86. For example, nozzle 82 may be coupled to another inflatable device and, when valve body 79 is in the FIG. 12 position, actuation of frame 18 as heretofore discussed inflates any inflatable object coupled to nozzle 82. In the FIG. 11 position, air can also be bled out of bellows 44 to adjust the same.

The entire assembly can be folded up and carried as a carrying case via handles 14, 15 and zipper 71'. By pushing push button 90 (FIG. 11), the valve 86 can be opened to bleed out a small amount of air and thus adjust the back rest portion 55' (FIG. 1) of the air mattress 17. Conventional wood, plastic, etc. may be used. Bellows 44 may have rigid integral frames 59, 60, etc. or such portions may be rigid securing rings secured to bellows 44, such as rings of metal or plastic.

The air mattress 17 can be of any suitable dimensions, such as about 6 feet long and 2 feet wide. Base portions 11, 13 may be about 15" in width and 18' in length.

Openings 47, 52 may be of any suitable diameter, such as 9/16 inches in diameter and spaced in an area of a suitable size, e.g., with a combined area of approximately 4–$\frac{1}{4}$ square inches.

The large area of the bellows (e.g., 1 square foot) allows a substantial amount of air ($\frac{1}{4}$ to 1 ft.$^3$) to be introduced into the lounge on each stroke. This, combined with a large orifice area (e.g., 1 to 4 square inches), allows the air lounge or other device to fill up with few strokes and virtually no resistance thus making a laborious task quick and easy.

It can be seen that there is disclosed an air mattress device wherein the air mattress or any inflatable device, such as a boat, can be quickly and easily inflated or deflated. Although inflation of an air mattress is disclosed, obviously other uses may occur to an artisan and the scope of the invention is only limited by the scope of the appended claims.

I claim:

1. An air mattress assembly comprising:

a first generally planar base portion movably connected to a second generally planar base portion;

an inflatable air mattress having an opening therein communicating with the interior thereof;

said first base portion having panel means with a flange plate mounted therein dividing said first base portion into an upper compartment and a lower compartment, said flange plate having at least a pair of spaced openings therethrough, one of said last-mentioned openings being aligned with the in said air mattress, said opening in said air mattress being in communication therewith;

a pair of spaced plates movably mounted with respect to said flange plate and disposed in said lower compartment, each of said spaced plates having a first imperforate portion with a plurality of spaced openings therethrough and a second portion with a large opening therethrough, said spaced openings in one spaced plate being vertically aligned with the large opening through the other of said spaced plates and the large opening in said one spaced plate being vertically aligned with the spaced openings in the other of said spaced plates, said spaced openings in said one spaced plate and said vertically aligned large opening in said second spaced plate also being vertically aligned with one of said openings in said flange plate and said large opening in said one spaced plate and said vertically aligned spaced openings in said second spaced plate also being vertically aligned with the other of said openings in said flange plate;

a resilient disk disposed between said spaced plates;

plate moving means associated with said pair of spaced plates for selectively aligning, in a first position, said spaced openings in said one spaced plate with said large opening in said second spaced plate, and, in a second position, aligning said large opening in said one spaced plate with said spaced openings in said second spaced plate; and a bellows assembly mounted in said first base portion having an exhaust in fluid communication with both said opening leading into said air mattress and with the side of said second spaced plate coaxially aligned with the opening leading into said air mattress, said bellows assembly also having an air intake in fluid communication with the atmosphere whereby, moving said second base portion selectively away from and toward said first base portion draws air from the atmosphere through said air intake, into said bellows assembly and out said exhaust into said air mattress.

2. In the assembly of claim 1 wherein said plate moving means includes a handle extending through said flange plate and coupled to said pair of spaced plates and accessible in said upper compartment.

3. In the assembly of claim 2 wherein said handle is an elongated member extending transversely across said flange plate in said upper compartment.

4. In the assembly of claim 3 wherein said flange plate and said pair of spaced plates are circular.

5. In the assembly of claim 1 including handle means associated with said first and second base portions for carrying the same.

6. In the assembly of claim 1 including an air tube having an inlet at one end and an outlet in fluid communication with the interior of said bellows assembly at its other end.

7. In the assembly of claim 6 wherein said outlet is selectively closable.

8. In the assembly of claim 1 wherein said first and second base portions are movably connected by a hinge.

9. In the assembly of claim 1 wherein the area of said opening in said air mattress and the area of said large openings through said spaced plates is about 4 to $4\frac{1}{4}$ square inches.

10. In the assembly of claim 1 wherein said resilient disk is of rubber and flexes against said large opening in said one spaced plate and away from said spaced openings in said one spaced plate when said large opening in said one spaced plate is in fluid communication with the opening leading into said air mattress.

11. A quick inflatable apparatus comprising:

an inflatable device having an opening leading therein for inflating the same;

a platform having a first section secured to said device and a second section movably secured to said first section; and a bellows apparatus mounted between said first and second sections and actuable to deliver air into said device when said first section is moved with respect to said second section, said bellows apparatus having an opening in fluid communication with the opening leading into said inflatable device; and selectable air expelling means associated with said bellows apparatus and one of said sections for selectively expelling air out of said inflatable device, through said bellows apparatus and into the atmosphere when said first section is moved with respect to said second section.

* * * * *